US007802383B2

(12) United States Patent
Dufort et al.

(10) Patent No.: US 7,802,383 B2
(45) Date of Patent: Sep. 28, 2010

(54) HITCHED GROOMING DEVICE FOR WINTER TRAILS

(76) Inventors: Luc Dufort, 1616, Sansoucy, St-Lin-des-Laurentides, Quebec (CA) J5M 1C5; Pascal Martin, 871, 12th Avenue, St-Lin-des-Laurentides, Quebec (CA) J5M 2W1

( * ) Notice: Subject to any disclaimer, the term of this patent is extended or adjusted under 35 U.S.C. 154(b) by 107 days.

(21) Appl. No.: 12/273,714

(22) Filed: Nov. 19, 2008

(65) Prior Publication Data

US 2009/0126236 A1 May 21, 2009

Related U.S. Application Data

(60) Provisional application No. 60/988,852, filed on Nov. 19, 2007.

(51) Int. Cl.
*E01H 4/00* (2006.01)

(52) U.S. Cl. ..... 37/221; 172/146

(58) Field of Classification Search ..... 37/219, 37/231, 293, 234, 266, 268, 270, 271, 279, 37/221; 172/799.5, 780, 197, 393, 623, 779, 172/787, 684.5, 146

See application file for complete search history.

(56) References Cited

U.S. PATENT DOCUMENTS

| | | | | | |
|---|---|---|---|---|---|
| 1,982,219 | A | * | 11/1934 | McAlister | 172/799.5 |
| 3,915,239 | A | * | 10/1975 | Hendrichon | 172/146 |
| 4,056,328 | A | * | 11/1977 | Maxey | 404/96 |
| 4,217,962 | A | * | 8/1980 | Schaefer | 172/197 |
| 4,337,586 | A | | 7/1982 | Buono | |
| 4,700,786 | A | * | 10/1987 | Berry | 172/799.5 |
| 4,802,293 | A | | 2/1989 | Smith | |
| 4,898,247 | A | | 2/1990 | Springfield | |
| 5,680,715 | A | * | 10/1997 | Thiboutot et al. | 37/219 |

FOREIGN PATENT DOCUMENTS

| | | |
|---|---|---|
| CA | 1026552 | 1/1976 |
| EP | 0882844 | 12/1998 |
| GB | 2369027 | 10/2001 |

* cited by examiner

*Primary Examiner*—Robert E Pezzuto

(57) ABSTRACT

A hitched grooming device having a tapered frame. a pivot allows for device to create a trail that is kept horizontal no matter the inclination of the terrain. Another pivot allows a compactor to rotate so that it can keep the trail as uniform as possible by keeping the compactor horizontal.

16 Claims, 5 Drawing Sheets

HITCHED GROOMING DEVICE FOR WINTER TRAILS

This application claims priority bases on provisional application 60,988,852 filed Nov. 19, 2007.

FIELD OF THE INVENTION

The present invention relates generally to hitched devices but more particularly to a device that is used for grooming trails used by snowmobiles or ATVs.

BACKGROUND OF THE INVENTION

ATVs and snowmobiles are very popular and special trails have been developed for practitioners of that activity. In order to maintain the trail however, there is a need for grooming implements.

Although a number of devices are used for that task, they are often simply repurposing existing devices to perform the task. For example, the prior art contains machinery use for working soil while other prior art uses similar soil working implements adapted for work on snow, such as substituting skis for wheels.

U.S. Pat. No. 1,026,552 hows an early example of a grooming device for skiers.

U.S. Pat. No. 3,915,239 shows a device having multiple articulated frames as well as a compactor at the end to compact the snow.

The use of angled plows or graters used for redirecting soil or snow is also knows in the art.

What is not well known, except perhaps for U.S. Pat. No. 4,898,247 is the use of the inclination of the graters, or blades to carve deeper on one side. U.S. Pat. No. 4,898,247 is for use on soil so it does not require a compactor and as such uses a leveling system based on actions from the rear wheels.

Because working on soil is different than working on snow, for example, soil needs to be fluffed and aerated in order to facilitate seeding and plant growth, whereas for snow trails, the snow needs to be compacted so as to remove the air and pack it solid. For this reason a device needs more than just obvious modifications in order to be adapted from soil use to snow use, and vice versa.

SUMMARY OF THE INVENTION

In view of the foregoing disadvantages inherent in the known devices now present in the prior art, the present invention, which will be described subsequently in greater detail, is to provide objects and advantages which are:

To break the now, move it so as to equalize dips and bumps, make the trail horizontal and even, and finally, compact it so that it provides a smooth even semi hard surface that is ideal for ATVs and snowmobiles.

In order to do so, the invention comprises a plurality of blades staggered and angled within a frame as is known in the art. But once the snow has been broken up, bumps leveled and holes filled, any surplus snow ends up on a final blade which is straight, that is, perpendicular to the direction it is moving towards. This straight blade is raised higher than all the preceding blades so as to let pass an even stream of snow, which is then compacted by the compactor.

Because of the angles and width of each angled blades, the snow is kept within the width of the grooming device. This arrangement of the angled blades, which consists on short blades, none of which being as wide as the device also reduces the drag, which requires less power from the towing vehicle which can translate in fuel economy. The sidings also help in maintaining the snow within the width of the grooming device and also present a smooth surface which reduces damage should the device rub against a tree. Compression springs on all blades allow the blades to absorb the impact of an impediment such as a rock or tree stump while moving forward, this reduces damage to the device. The compression helps not only in being pushed back at the moment of impact but also to move up slightly so as to pass over the impediment.

Four tires are used for more stability when used off trails. The redundancy also allows four up to two tires to go flat before losing stability.

The grooming device, hereinafter referred to as either the grooming device or the device, has a tapered main frame, staggered angled blades and a straight blade attached to attached to the frame. A second pivot, set along a horizontal axis, allows for the device to create a trail that is kept horizontal no matter the inclination of the terrain by pivoting around the horizontal axis.

A second pivot actuating means to move the frame in relation to the towing vehicle so that the trail can be leveled horizontally across its width. A compactor frame is hingedly attached to a beam by way of hinges. The beam is itself attached to the frame by way of the second pivot. A third pivot rotates along a horizontal axis so as to allow the compactor to rotate along a horizontal axis set perpendicularly to the second pivot's horizontal axis, but in the same horizontal plane, so that its toe won't dig in if the towing vehicle goes downward or its heel won't dig in if the towing vehicle goes up a hill.

In an alternate embodiment, the grooming device has a tapered front frame and a tapered rear frame. A first pivot, along a vertical axis, pivotally connects the front frame to the rear frame and is actuated by at least one first pivot actuating means.

The hitched grooming has its weight transferred over to the compactor by way of an arm which is off center towards the rear of the compactor so as to apply pressure towards the rear of the compactor.

The device is raised by way of a device raising means which usually comes in the guise of a hydraulic means such as a piston so as to adjust the height of the blades as well as for off trail transport of the device.

The blades are hingedly connected to the front frame and the rear frame and use compression springs to allow the blades to absorb an impact.

The front frame and the rear frame have sidings so as to maintain the snow within the width of the device.

The compactor does the entire width of the device and is rounded both front and back so as to make up a toe at the front and a heel at the back.

The compactor has changeable vertical rudders so as to prevent side to side sliding of the device.

The straight blade is raised higher than all the preceding blades so as to let pass an even stream of snow, which is then compacted by the compactor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

Figure 1:
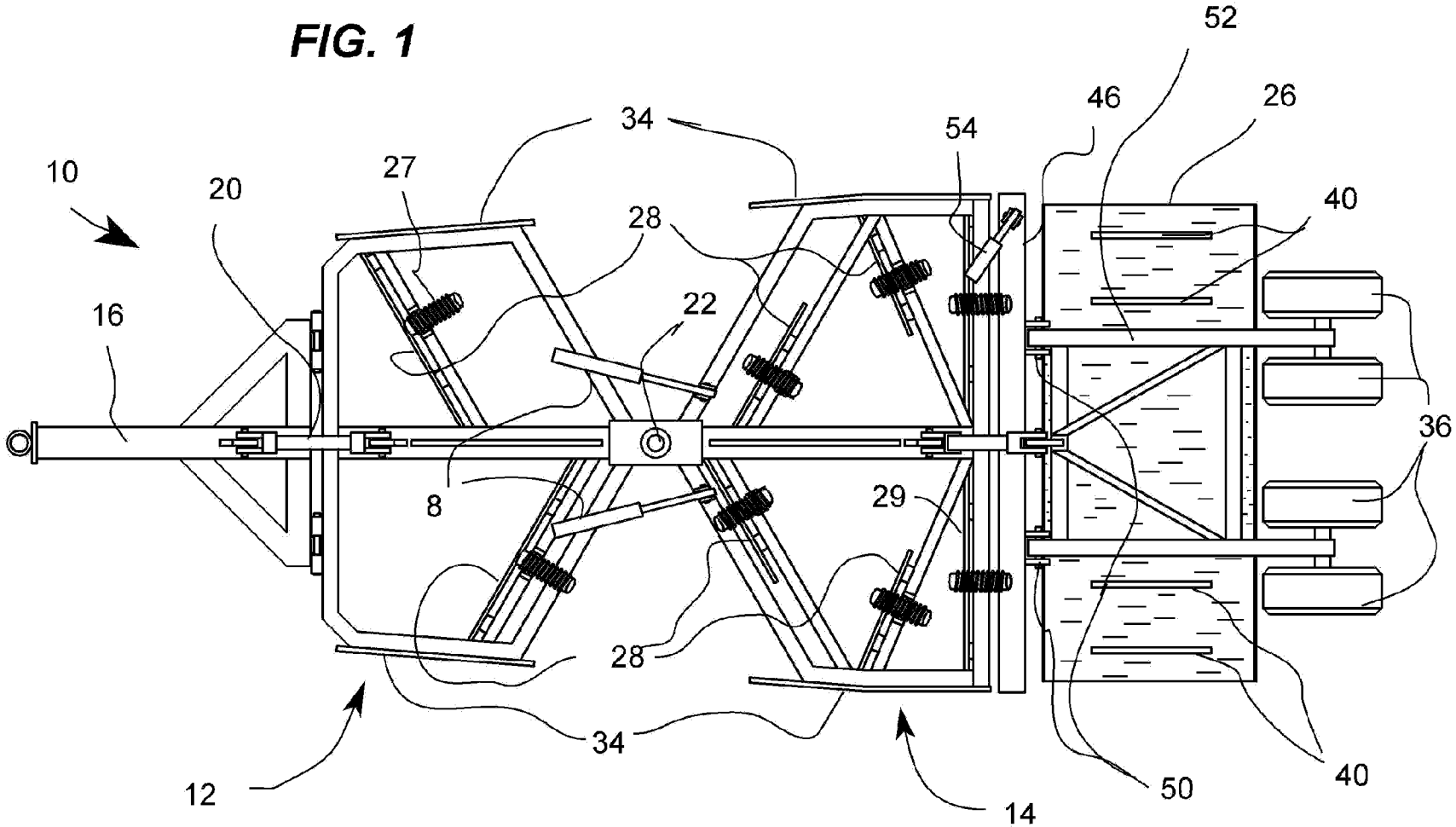
FIG. 1 Top view of the invention.
Figure 2:
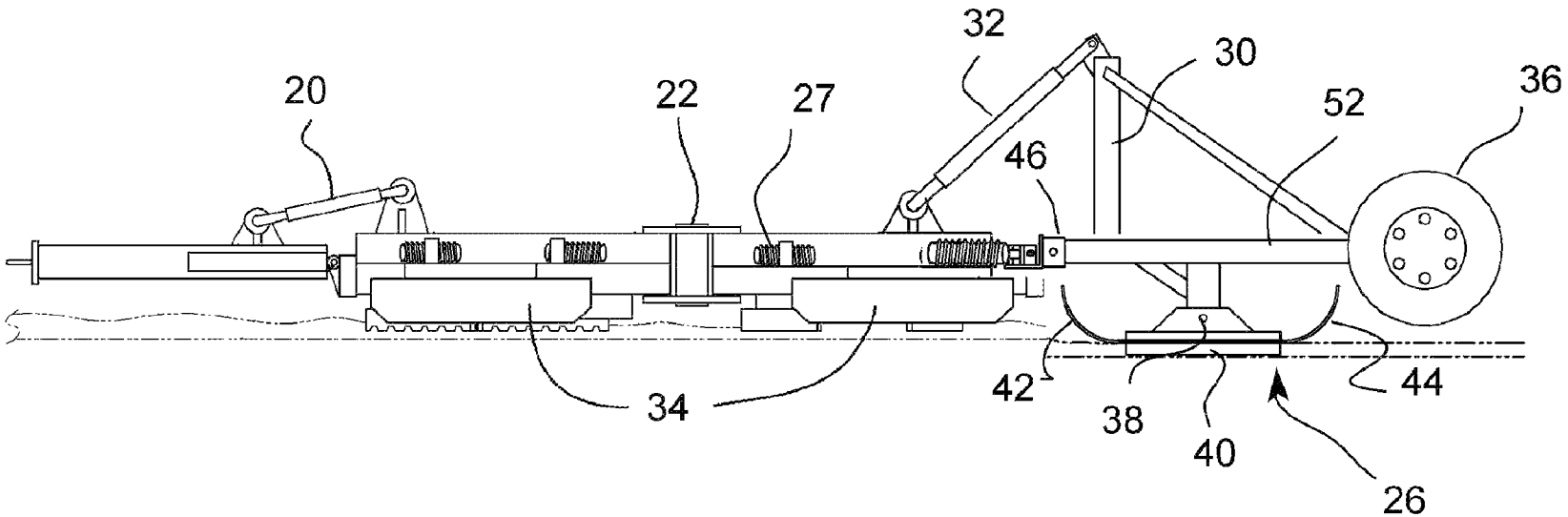
FIG. 2 Side view of the invention.
Figure 3:
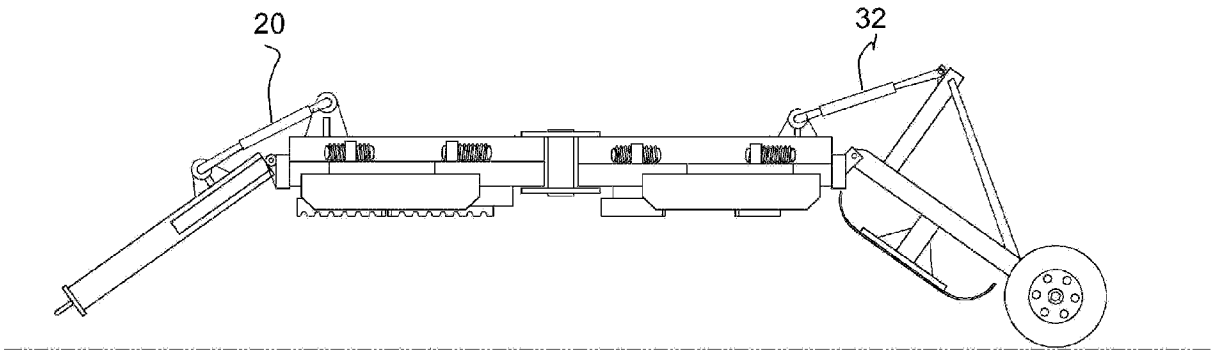
FIG. 3 Alternate side view of the invention showing articulation.

A hitched grooming device (10) has a tapered main frame, also known as front frame (12) and, in the preferred embodiment shown in the figures, a tapered rear frame (14). Although the device (10) can operate as a single frame, namely the front frame (12), as long as it contains the same amount of angled blades (28) as the device (10) with both a front frame (12) and a rear frame (14). The advantage of a two frame device (10) is the articulation between the front frame (12) and the rear frame (14) which allows for tighter turns. The front frame (12) has a hitch draw bar (16) so that it can be attached to a towing vehicle (not shown). The rear frame (14) contains the straight blade (29) and connects to a compactor (26) in a fashion that will be described later. All the blades (28, 29) have a compression spring (27) for the purpose described herein above. The blades are otherwise hingedly connected to the frames (12, 14) with the compression springs (27) acting like biasing means, somewhat like a spring on a door biases a door a certain way.

The frames (12, 14) having sidings (34) which help in maintaining the snow within the width of the grooming device (10).

A leveling piston (54) moves the frames (12, 14) in relation to the towing vehicle so that the trail can be leveled horizontally across its width, despite the towing vehicle being leveled differently. Very useful since snow tends to accumulate unevenly when ATVs push it towards the outside of the trail.

The compactor (26), which does the entire width of the device (10), is rounded both front and back—which make up a toe (42) and a heel (44), respectively—to make it easy for the device to back up if needed. The compactor (26) is also equipped with changeable vertical rudders (44) that prevent side to side sliding of the device (10).

The compactor frame (52) is hingedly attached to a beam (46) by way of hinges (50). The beam (46) is itself attached to the rear frame (14) by way of a second pivot (24). A third pivot (38) allows the compactor (26) to rotate along a horizontal axis so that its toe (42) won't dig in if the towing vehicle goes downward or its heel (44) won't dig in if the towing vehicle goes up a hill. It is important since what happens where the towing vehicle (not shown) is located is not exactly what happens twenty feet behind where the device (10) is.

Also, the compactor (26) rotates along a horizontal axis (38) so that it always follows the trail without digging in from the toe or the heel.

Four tires (36) are used for more stability when used off trails. The redundancy also allows four up to two tires to go flat before losing stability.

Figure 5:
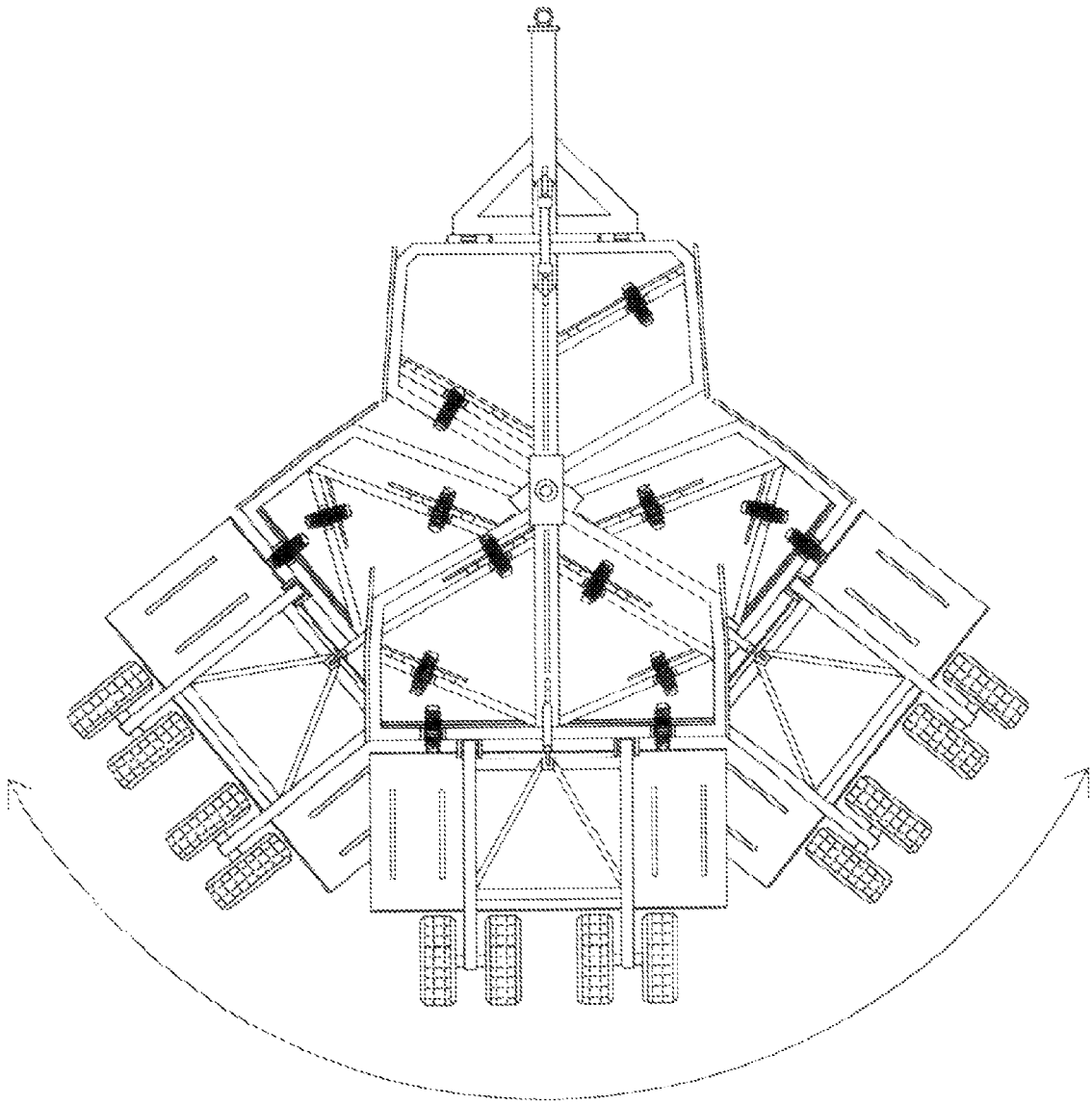
FIG. 5 Alternate top view of the invention showing articulation.

A first pivot (22) pivotally connects the front frame (12) to the rear frame (14) and is actuated by at least one first pivot actuating means (8) which usually comes in the guise of a hydraulic means such as a piston. The movement, which allows the rear frame (14) to pivot horizontally, as seen in FIG. 5, is along a vertical axis and can be as much as 60 degrees on each side.

Figure 4:
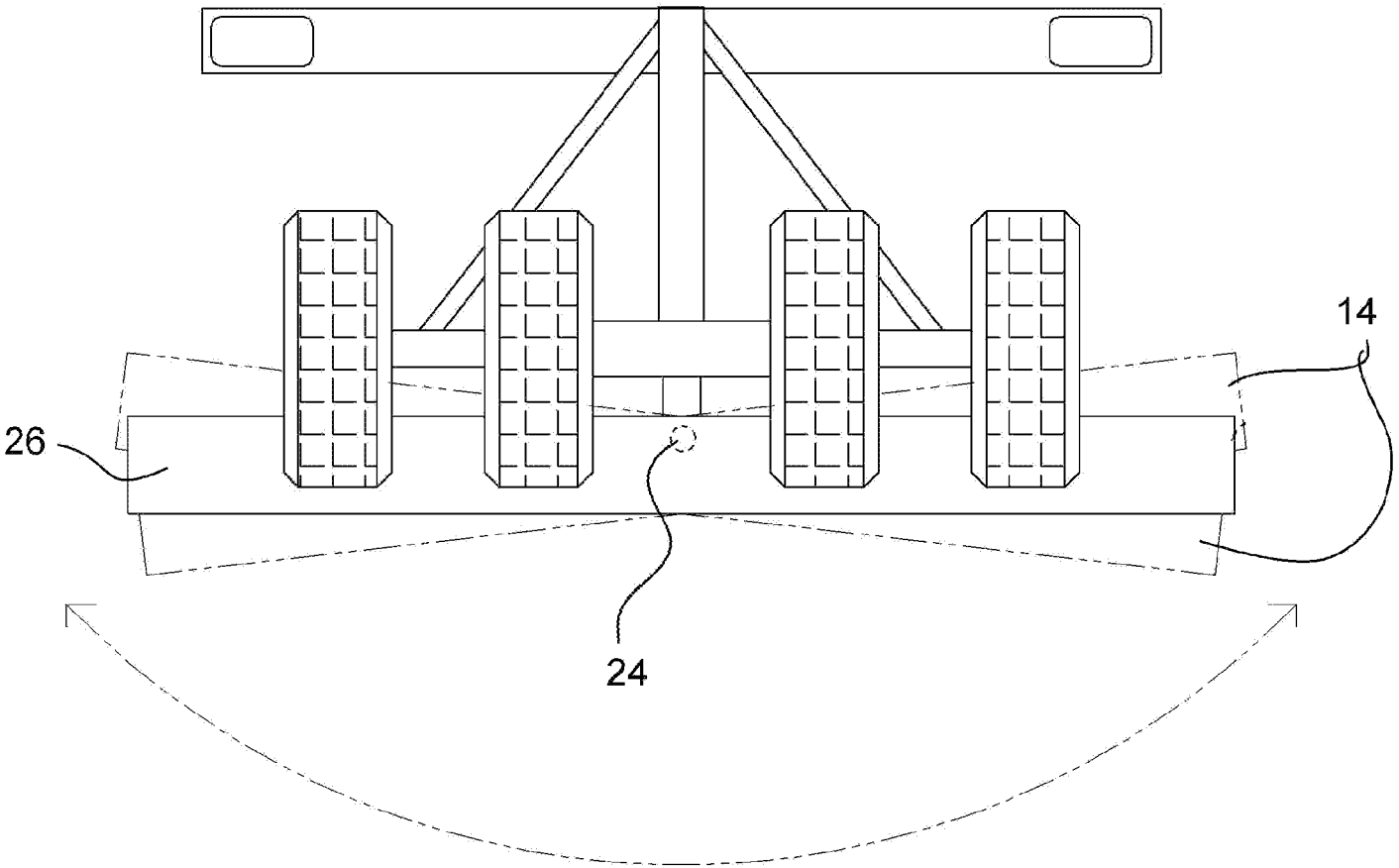
FIG. 4 Rear view of the invention.

The second pivot (24) allows for the device (10) to create a trail that is kept horizontal no matter the inclination of the terrain by pivoting around a horizontal axis, as seen in FIG. 4. To do so, a beam (46), hingedly attached to a compactor frame (52), by way of the second pivot (24) is actuated by a second pivot actuating means (54) which interfaces between the compactor frame (52) and the rear frame (14). This action rotates the front and rear frame (12, 14) which consequently changes the angle of the blades (28, 29) so as to carve a horizontal trail.

The weight of the device (10) is transferred over to the compactor (26) by way of an arm (30) which is off center towards the rear of the compactor (26) so as to apply pressure towards the rear of the compactor (26).

The device (10) can be raised by way of a device raising means (20, 32) which usually comes in the guise of a hydraulic means such as a piston. Raising the device (10) is usually for off trail transport, but small adjustment in the height of the device (10) is used for adjusting the height of the blades (28).

The blades (28) remove the excess snow and prepare the surface for the compactor (26). This particular aspect of using blades for removing excess snow is similar in other devices, except for a number of key points. The first is the use of compression springs (27) which allow the blades (28) to absorb an impact, should it hits on a rock, tree stump or other impediment. Absorbing the shock minimizes the risks of damaging the blade (28). Also, the other devices of the prior art do not have the three pivots which allow for perfect leveling of the trail no matter its inclination.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A hitched grooming device comprising:

a tapered main frame, a plurality of staggered angled blades at least one straight blade attached to the tapered main frame;

a second pivot, pivoting around a horizontal axis a second pivot actuating means to move the tapered main frame in relation to a towing vehicle so as to horizontally level a trail across its width;

a compactor frame hingedly attached to a beam by way of hinges;

the beam being attached to the tapered main frame by way of the second pivot;

a third pivot rotating so as to allow the compactor to rotate along a compactor's horizontal axis;

the compactor's horizontal axis being in the same horizontal plane but perpendicular relative to the second pivot's horizontal axis;

the compactor's horizontal axis preventing the compactor's toe to dig into the trail when the towing vehicle goes down a hill or preventing the compactor's heel to dig into the trail when the towing vehicle goes up a hill.

2. A hitched grooming device as in claim 1 wherein:

the weight of the hitched grooming device is transferred over to the compactor by way of an arm which is off center so as to apply pressure towards the rear of the compactor.

3. A hitched grooming device as in claim 1 wherein:

the hitched grooming device is raised by way of a device raising means which usually comes in the guise of a hydraulic means such as a piston so as to adjust the height of the blades as well as for off trail transport of the device.

4. A hitched grooming device as in claim 1 wherein:

the blades are hingedly connected to the frame and use compression springs to allow the blades to absorb an impact.

5. A hitched grooming device as in claim 1 wherein:

the frame has sidings so as to maintain the snow within the width of the hitched grooming device.

6. A hitched grooming device as in claim 1 wherein:

the compactor is as wide as the width of the hitched grooming device and has a rounded toe at its front and a rounded heel at its back.

7. A hitched grooming device as in claim 1 wherein:

the compactor has changeable vertical rudders so as to prevent side to side sliding of the device.

8. A hitched grooming device as in claim 1 wherein:

the straight blade is raised higher than all the preceding blades so as to let pass an even stream of snow, which is then compacted by the compactor.

9. A hitched grooming device comprising:

a tapered main frame, a plurality of staggered angled blades at least one straight blade attached to the tapered main frame;

a first pivot, along a vertical axis, pivotally connects the front frame to the rear frame and is actuated by at least one first pivot actuating means;

a second pivot, pivoting around a horizontal axis a second pivot actuating means to move the tapered main frame in relation to a towing vehicle so as to horizontally level a trail across its width;

a compactor frame hingedly attached to a beam by way of hinges;

the beam being attached to the tapered main frame by way of the second pivot;

a third pivot rotating so as to allow the compactor to rotate along a compactor's horizontal axis;

the compactor's horizontal axis being in the same horizontal plane but perpendicular relative to the second pivot's horizontal axis;

the compactor's horizontal axis preventing the compactor's toe to dig into the trail when the towing vehicle goes down a hill or preventing the compactor's heel to dig into the trail when the towing vehicle goes up a hill.

10. A hitched grooming device as in claim 9 wherein:

the weight of the hitched grooming device is transferred over to the compactor by way of an arm which is off center so as to apply pressure towards the rear of the compactor.

11. A hitched grooming device as in claim 9 wherein:

the hitched grooming device is raised by way of a device raising means which usually comes in the guise of a hydraulic means such as a piston so as to adjust the height of the blades as well as for off trail transport of the device.

12. A hitched grooming device as in claim 9 wherein:

the blades are hingedly connected to the frame and use compression springs to allow the blades to absorb an impact.

13. A hitched grooming device as in claim 9 wherein:

the front frame and the rear frame have sidings so as to maintain the snow within the width of the hitched grooming device.

14. A hitched grooming device as in claim 9 wherein:

the compactor is as wide as the width of the hitched grooming device and has a rounded toe at its front and a rounded heel at its back.

15. A hitched grooming device as in claim 9 wherein:

the compactor has changeable vertical rudders so as to prevent side to side sliding of the device.

16. A hitched grooming device as in claim 9 wherein:

the straight blade is raised higher than all the preceding blades so as to let pass an even stream of snow, which is then compacted by the compactor.

* * * * *